US005999790A

United States Patent [19]

Folkins

[11] Patent Number: 5,999,790

[45] Date of Patent: Dec. 7, 1999

[54] FIVE CYCLE COLOR PRINTING ARCHITECTURE WITH A CAMMING MECHANISM FOR ENGAGING AND DISENGAGING A TRANSFER AND CLEANING STATIONS

[75] Inventor: Jeffrey J. Folkins, Rochester, N.Y.

[73] Assignee: Xerox Corporation, Stamford, Conn.

[21] Appl. No.: 09/165,430

[22] Filed: Oct. 2, 1998

[51] Int. Cl.[6] ..... G03G 21/00

[52] U.S. Cl. ..... 399/345

[58] Field of Search ..... 399/313, 345

[56] References Cited

U.S. PATENT DOCUMENTS 5,051,783 9/1991 Sato ..... 399/343

*Primary Examiner*—Sandra Brase
*Assistant Examiner*—William A. Noe
*Attorney, Agent, or Firm*—Lloyd F. Bean, II

[57] ABSTRACT

A color marking machine which produces a composite color image in five cycles of a photoreceptive member, said color marking machine including a continuous photoreceptive member; a drive system rotating said photoreceptive member in a first direction; a charging station (R) for charging said photoreceptive member; an exposure station (E) for exposing said photoreceptive member so as to produce latent images on said photoreceptive member; a development station (D) for developing said latent images with toner to produce a toner image on said photoreceptive member; a transfer station (T) for transferring said toner image from said photoreceptive member onto a substrate; and a cleaning station (C) for removing residual toner particles from said photoreceptive member; and an camming assembly, operatively connected to said cleaning station and said transfer station, for engaging and disengaging said cleaning station and transfer station to and from said photoreceptive member.

4 Claims, 2 Drawing Sheets

FIVE CYCLE COLOR PRINTING ARCHITECTURE WITH A CAMMING MECHANISM FOR ENGAGING AND DISENGAGING A TRANSFER AND CLEANING STATIONS

FIELD OF THE INVENTION

This invention relates to electrophotographic printer architectures. In particular to a five cycle color printing architecture with a camming mechanism for engaging and disengaging a transfer and cleaning station.

BACKGROUND OF THE INVENTION

Electrophotographic marking is a well known and commonly used method of copying or printing documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed in superimposed registration so that a desired composite color image results. That composite color image is then transferred and fused onto a substrate.

The REaD IOI process can be implemented in various ways. For example, in a single pass printer wherein the composite final image is produced in a single pass of the photoreceptor through the machine. A second implementation is in a four pass printer, wherein only one color toner image is produced during each pass of the photoreceptor through the machine and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass through the machine.

Single pass printing is very fast, but expensive since four charging stations and four exposure stations are required. Four pass printing is slower, since four passes of the photoreceptive surface are required, but also much less expensive since it only requires a single charging station and a single exposure station. Five cycle printing is even slower since five passes of the photoreceptive surface are required, but has the advantage that multiple uses can be made of various stations (such as using a charging station for transfer). Furthermore, five cycle printing also has the advantage of a smaller physical size. Finally, five cycle printing has a decided advantage in that no color image is produced in the same cycle as transfer, fusing, and cleaning when these mechanical loads are placed on the drive system.

While electrophotographic printing has been very successful, the rapid growth of the computer industry has created a tremendous demand for desktop printing machines, particularly color desktop printing machines. Desirable features of desktop color printing machines include excellent print quality, high speed printing, low cost, and small size. Those desirable characteristics are difficult to achieve simultaneously using prior art electrophotographic printing machine architectures. Therefore, designers of electrophotographic color marking machines would benefit from new architectures since new architectures would increase their design flexibility to achieve high quality, relatively high speed, and low cost desktop printing machines.

An object of the present invention is to simplify the operation and cost of manufacture of a five cycle color printing architecture by providing a common camming mechanism for engaging and disengaging a transfer and cleaning stations.

SUMMARY OF THE INVENTION

A color marking machine which produces a composite color image in five cycles of a photoreceptive member, said color marking machine including a continuous photoreceptive member; a drive system rotating said photoreceptive member in a first direction; a charging station for charging said photoreceptive member; an exposure station for exposing said photoreceptive member so as to produce latent images on said photoreceptive member; a development station for developing said latent images with toner to produce a toner image on said photoreceptive member; a transfer station for transferring said toner image from said photoreceptive member onto a substrate; and a cleaning station for removing residual toner particles from said photoreceptive member; and a camming assembly, operatively connected to said cleaning station and said transfer station, for engaging and disengaging said cleaning station and transfer station to and from said photoreceptive member.

BRIEF DESCRIPTION OF THE DRAWINGS

Other aspects of the present invention will become apparent as the following description proceeds and upon reference to.

DETAILED DESCRIPTION OF PREFERRED EMBODIMENTS OF THE INVENTION

The preferred embodiments of the present invention are electrophotographic printing machines that include a plurality of individual subsystems which are known in the prior art, but which are organized and used so as to produce a color image in 5 passes, or cycles, of a photoreceptive member. While 5 cycle color electrophotographic architectures have a 20% loss of productivity over a comparable 4 cycle color electrophotographic architecture, the additional cycle allows for significant size and cost reductions. Furthermore, the principles of the present invention enable significant design flexibility in implementing 5 cycle electrophotographic printing.

Figure 1:
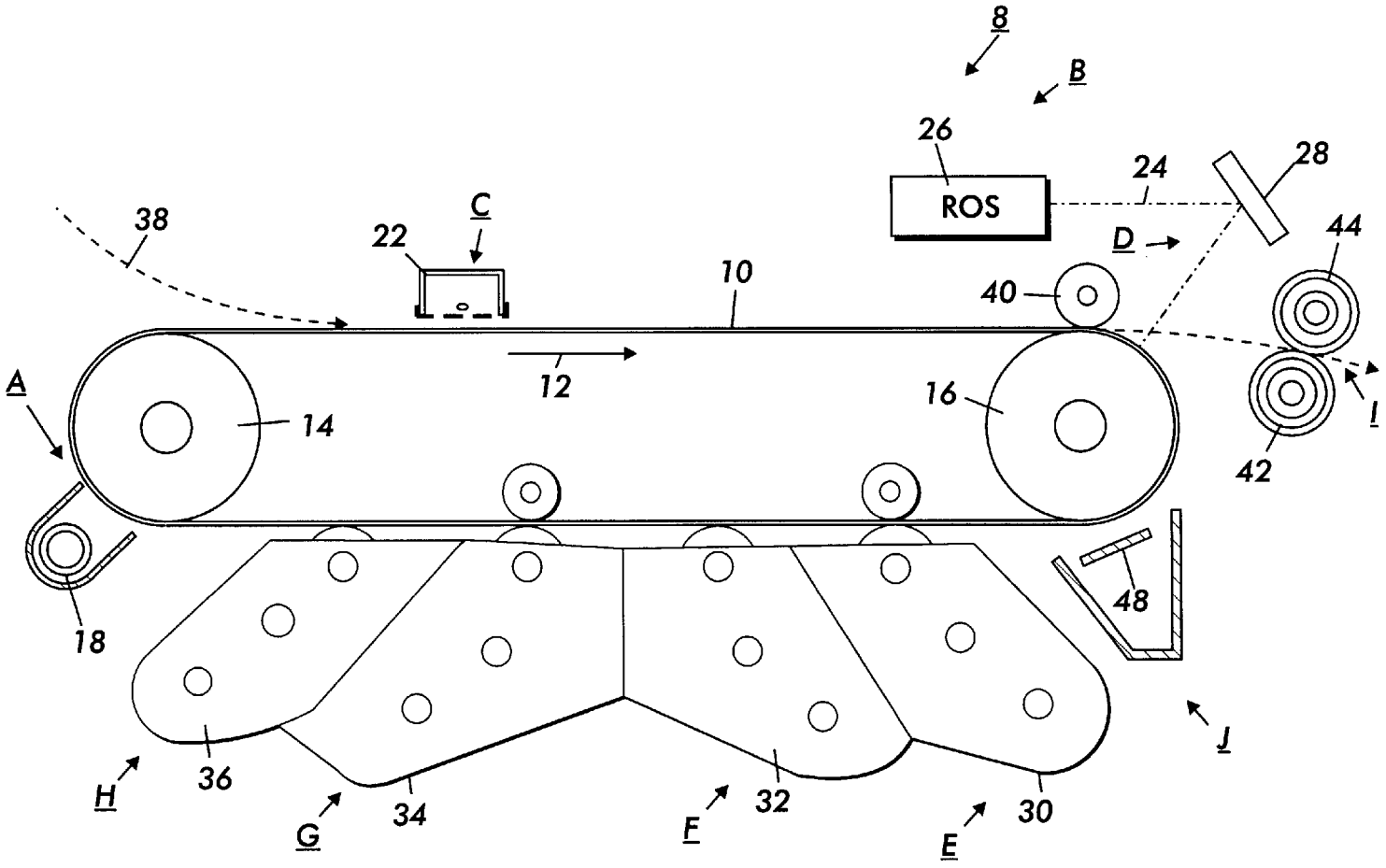
PRIOR ART FIG. 1
FIG. 1 schematically illustrates a prior art 5 cycle electrophotographic printing machine.

As previously indicated the preferred embodiments of the present invention are electrophotographic marking machines, beneficially 5 cycle printing machines, that have novel system architectures. To understand the principles of the present invention it is helpful to understand prior art 5 cycle printing machines. FIG. 1 illustrates a prototypical prior art color electrophotographic, 5 cycle, printing machine 8. The printing machine 8 includes an Active Matrix (AMAT) photoreceptor belt 10 which travels in the direction indicated by the arrow 12. Belt travel is brought about by mounting the belt about a drive roller 16 (which is driven by a motor which is not shown) and a tension roller 14.

As the photoreceptor belt travels each part of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas, since each image area is processed in the same way a description of the processing of one image area suffices to fully explain the operation of the printing machine.

As mentioned, the production of a color document takes place in 5 cycles. The first cycle begins with the image area passing through an erase station A. At the erase station an erase lamp 18 illuminates the image area so as to cause any residual charge which might exist on the image area to be discharged. Such erase lamps and their use in erase stations are well known.

As the photoreceptor belt continues its travel the image area passes through a system charging station consisting of a charging station C. At the charging station C a corona generating device 22, scorotron, charges the image area to a substantially uniform potential of, for example, about −500 volts. Note that the purpose of the charging station is to produce charge on the photoreceptor. The same station can either charge the photoreceptor, if the photoreceptor did not have a previous charge, or recharge the photoreceptor, if it previously had a charge. Therefore, depending on context, charging and recharging are used as alternatives.

After passing through the charging station C the now charged image area passes through an exposure station D. At the exposure station D the charged image area is exposed to the output 24 of a laser based output scanning device 26 which reflects from a mirror 28. During this first cycle the output 24 illuminates the image area with a light representation of a first black image. That light representation discharges some parts of the image area so as to create an electrostatic latent representation of the exposing light. For example, illuminated sections of the image area might be discharged by the output 24 to about −50 volts. Thus after exposure the image area has a voltage profile comprised of relatively high voltages of about −500 volts and of relatively low voltages of about −50 volts. The −500 volts exists on those parts of the image area which were not illuminated while the −50 volts exists on those parts which were illuminated.

After passing through the exposure station D the exposed image area passes a black development station E which deposits negatively charged black toner 30 onto the image area. The charged black toner adheres to the illuminated image area causing the voltage of the illuminated parts of the image area to be about −200 volts. The non-illuminated parts of the image area remain at −500 volts.

After passing the black development station E, the image area advances to the charging station C and the second cycle begins. The charging station C uses its corona generating device 22 to charge the image area and its toner to negative voltage levels so as to charge the image area to about −500 volts. While the average potential of the black toner layer after it passes the second charging station is about −500 volts, individual toner particles will have potentials which vary widely.

After passing through the charging station C the now substantially uniformly charged image area with its black toner layer advances to the exposure station D. At the exposure station D the recharged image area is exposed to the output 24 of a laser based output scanning device 26. During this cycle the scanning device 26 illuminates the image area with a light representation of the color yellow. That light representation discharges some parts of the image area so as to create a yellow electrostatic latent representation. For example, the non-illuminated parts of the image area have a potential about −500 while illuminated areas are discharged to about −50 volts. It should be understood that individual toner particles will have potentials which vary widely.

After passing the exposure station D the now exposed image area passes a yellow development station F which deposits yellow toner 32 onto the image area. Since the image area already has a black toner layer the yellow development station F should include a scavengeless developer or another "non interactive" developer which has the property that it does deposits toner on the intended image areas without disturbing toner on previous color image areas.

After passing the yellow development station F the image area and its two toner layers advance to the first charging station C and the third cycle begins. The charging station C uses its corona generating device 22 to charge the image area and its two toner layers to negative voltage levels of about −500 volts. The substantially uniformly charged image area with its two toner layers then advances again to the exposure station D. At exposure station D the image area is again exposed to the output 24 of the laser based output scanning device 26. During this cycle the scanning device 26 illuminates the image area with a light representation of the color magenta. That light representation discharges some parts of the image area so as to create a magenta electrostatic latent representation.

After passing the exposure station D the third time the image area passes through a magenta development station G. The magenta development station G, preferably a scavengeless or other non-interactive developer, advances magenta toner 34 onto the image area. The result is a third toner layer on the image area.

The image area with its three toner layers then advances to the charging station C and the fourth cycle begins. The charging station C again uses its corona generating device 22 to charge the image area (and its three toner layers) to negative voltage levels of about −500 volts. The substantially uniformly charged image area with its three toner layers then advances again to the exposure station D. At the exposure station D the recharged image area is again exposed to the output 24 of the laser based output scanning device 26. During this cycle the scanning device 26 illuminates the image area with a light representation of cyan. That light representation discharges some parts of the image area so as to create a cyan electrostatic latent representation. After passing the exposure station D the image area passes a cyan development station H. The cyan development station, also a scavengeless or other non-interactive developer, advances a cyan toner 36 onto the image area.

After passing the cyan development station the image area has four toner powder images which make up a composite color powder image. The fifth cycle begins by passing the image area through the erase station A. At erase station A the erase lamp 18 discharges the image area to a relatively low voltage level. This reduces the potentials of the image area, including that of the composite color powder image, to near zero. As the image area advances a substrate 38 is placed over the image area using a sheet feeder (which is not shown). As the image area and substrate continue their travel they pass the charging station C.

At charging station C the corona generating device 22 applies positive ions onto the substrate 38. The positive ions attract the negatively charged toner particles onto the substrate. As the substrate continues its travel the substrate passes a bias transfer roll 40 which assists in attracting the toner particles to the substrate and in separating the substrate with its composite color powder image from the photoreceptor belt 10. Additionally, the entire task of charging the substrate 38 to attract toner particles to it could be performed simply by the bias transfer roll 40 rather than through the combination of 40 and charger 22. The substrate is then directed into a fuser station I where a heated fuser roll 42 and a pressure roller 44 create a nip through which the substrate passes. The combination of pressure and heat at the nip causes the composite color toner image to fuse into the substrate 38. After fusing, a chute, not shown, guides the support sheets 38 to a catch tray, also not shown, for removal by an operator.

After the substrate is separated from the photoreceptor belt 10 the image area continues its travel and eventually enters a cleaning station J. At cleaning station J a cleaning blade 48 is brought into contact with the image area. That blade wipes residual toner particles from the image area. The image area then passes once again to the erase station A and the 5 cycle printing process begins again.

Using well known technology the various machine functions described above are generally managed and regulated by a controller which provides electrical command signals for controlling the operations described above.

Figure 2:
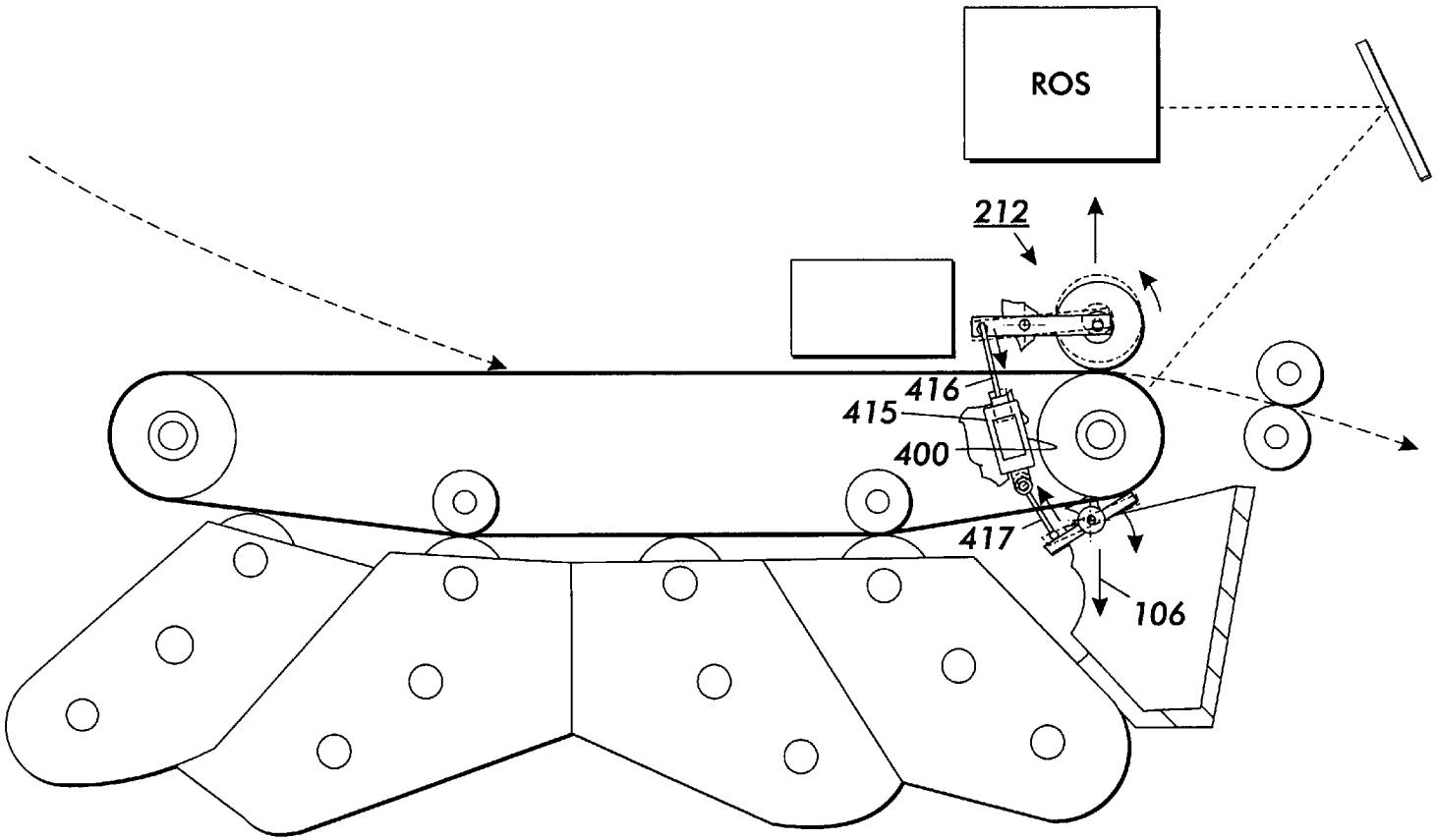
FIG. 2 illustrates the relative locations of various stations in a first embodiment of a 5 cycle electrophotographic printing machine that is in accord with the principles of the present invention.

An embodiment of the present invention is provided in FIG. 2. Due to the close proximity of the Transfer Station and the cleaning station (both physically and with respect to the P/R process) as well as the common use of comparably large interdocument zones in the architecture, the fifth cycle engagement and disengagement of the transfer station 212 and the blade cleaner 106 can occur at about the same time. Hence it is proposed that a further cost/complexity reduction can be made with the architecture by tying together the required camming engagement/disengagement operations by the use of a common camming apparatus 400 which is operatively connected to both transfer station and the blade cleaner. In this way only a single electrical I/O control and a single mechanical actuator 415 (e.g. solenoid) would be required to perform both functions.

Camming apparatus 400 includes member 416 and member 417 which is operatively connected to transfer station and the cleaning station during operation of cycle 5. Solenoid 415 moves members 416 and 417 so that transfer station is engaged when the substrate passes thereon and moves the cleaning blade into a clean position to clean the photoreceptor.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A color marking machine which produces a composite color image in five cycles of a photoreceptive member, said color marking machine comprised of:

a continuous photoreceptive member;

a drive system rotating said photoreceptive member in a first direction;

a charging station for charging said photoreceptive member;

an exposure station for exposing said photoreceptive member so as to produce latent images on said photoreceptive member;

a development station for developing said latent images with toner to produce a toner image on said photoreceptive member;

a transfer station for transferring said toner image from said photoreceptive member onto a substrate; and a cleaning station for removing residual toner particles from said photoreceptive member; and an electromechanical linkage assembly, operatively connected to said cleaning station and said transfer station, for engaging or disengaging said cleaning station and said transfer station to and from said photoreceptive member with a single actuation.

2. The color marking machine of claim 1, wherein said electromechanical linkage assembly includes a member operatively connected to said cleaning station and transfer station and a solenoid for moving said member.

3. A printing machine, comprising:

continuous photoreceptive member;

a drive system rotating said photoreceptive member in a first direction;

a charging station for charging said photoreceptive member;

an exposure station for exposing said photoreceptive member so as to produce latent images on said photoreceptive member;

a development station for developing said latent images with toner to produce a toner image on said photoreceptive member;

a transfer station for transferring said toner image from said photoreceptive member onto a substrate; and a cleaning station for removing residual toner particles from said photoreceptive member; and an electromechanical linkage assembly, operatively connected to said cleaning station and said transfer station, for engaging or disengaging said cleaning station and transfer station to and from said photoreceptive member with a single actuation.

4. The printing machine of claim 3, wherein said electromechanical assembly includes a member operatively connected to said cleaning station and transfer station and a solenoid for moving said member.

* * * * *